United States Patent [19]

Fritz et al.

[11] 4,164,189

[45] Aug. 14, 1979

[54] DOOR ASSEMBLIES FOR CLOSING RAIL CAR END OPENING

[75] Inventors: William E. Fritz, Longwood, Fla.; Mark L. Graves, Munster, Ind.; Robert F. Seitz, Mentor, Ohio

[73] Assignee: The Youngstown Steel Door Company, Cleveland, Ohio

[21] Appl. No.: 664,913

[22] Filed: Mar. 8, 1976

[51] Int. Cl.[2] ..... B61D 19/00; E05B 65/14

[52] U.S. Cl. ..... 105/378; 105/368 R; 105/410; 160/213; 292/189; 292/DIG. 32

[58] Field of Search ..... 105/368 R, 378, 410; 160/213; 292/189, 302, DIG. 32; 296/50, 53, 55, 56, 57 R, 147, 148, 155

[56] References Cited

U.S. PATENT DOCUMENTS

| | | | |
|---|---|---|---|
| 1,040,817 | 10/1912 | Tutwiler et al. | 160/213 X |
| 3,911,831 | 10/1975 | Blunden | 105/368 R X |
| 3,938,446 | 2/1976 | Seitz et al. | 105/368 R |

*Primary Examiner*—Randolph A. Reese
*Attorney, Agent, or Firm*—John H. Mulholland

[57] ABSTRACT

A multi-deck rail car having an interior cavity and an end opening for loading and unloading lading is provided with a pair of door assemblies, each of which includes a plurality of panels. Each door assembly is pivotally movable for closing at least a portion of the end opening. Double vertical pivots mount each of the door assemblies and are provided such that they move the door assemblies between their respective open position, storage position and closed position. The double vertical pivot means are cranks pivoted at either end to permit pivoting of the door assemblies for storage within the rail car, when their panels are folded back upon one another. A lock for the doors includes a rigid projection extending from the edge of a first one of the panels behind and past an adjacent edge of the second of the two panels and in register with a cutout in the adjacent edge of the second panel. A locking bar is mounted on the second door for reciprocal movement in a vertical direction such that gravity can act to lock the door. A locking cam is pivotally mounted adjacent the bar for engagement with a stop projection on the bar to selectively permit the bar to be lifted.

10 Claims, 10 Drawing Figures

DOOR ASSEMBLIES FOR CLOSING RAIL CAR END OPENING

BACKGROUND OF THE INVENTION

Broadly, as pointed out in application, U.S. Ser. No. 503,747, filed Sept. 6, 1974, now U.S. Pat. No. 3,938,446, and owned in common with the instant application, it has been known that by using bi-fold doors, the ends of decked automobile transport rail cars can be closed. There has been a problem, however, that when the cars are opened, the doors can get outside the clearance diagram and be easily damaged. Moreover, the doors should be able to be opened when the cars are coupled for access to the interior of the rail car and the lading. Also, when the operator has delivered an automobile to an upper deck, he must be able to reach a ladder; therefore, he must be able to get around the folded and stored door panels. After the car is loaded, the door must be operable from the ground; and, of course, the door must not jam when it is going into or out of the storage position.

The rail car of the present invention, with its novel door assemblies and door arrangements, can solve all of these problems as well as provide a positive lock of the doors in both the closed condition and the folded back and stored condition. This is made possible by the use of three panels, which are pivoted on their marginal edges for swinging relative to each other. Two sets of the three panels are used to close and lock the opening. The panels fold back upon themselves on hinges along their edges and are pivotally mounted adjacent to the outer sides of the opening on double pivoted crank neans which permit them each to move as a folded three-panel unit into the interior of the car to the stored position. The mechanism for accomplishing these desirable ends will be described in the Brief Description of the Invention to follow.

BRIEF DESCRIPTION OF THE INVENTION

The invention involves a multi-deck rail car having an interior cavity and an end opening for loading and unloading lading such as vehicles. Two door assemblies, each including a set of three panels are provided for closing the end opening. Each of the sets of panels closes one-half of the opening and each panel folds back upon the other panels of the set by means of hinges at the edges thereof for storage. The sets of door panels are each pivotally mounted adjacent the sides of the opening by means of double vertical pivoting cranks for movement toward and away from the interior of the car to permit storage of the sets of folded panels entirely within the car.

The rail car has a plurality of horizontally disposed interior decks, each having its corner cut off on the edge of the decks adjacent the end opening. The double vertical pivoting cranks move such that the sets of folded panels are permitted to swing into storage position, clearing the decks, because of the absence of these corners.

In the closed position, two adjacent panels of each door assembly or set can be locked together by means which maintain them in co-planar relationship. The lock means includes a rigid projection extending from the edge of one of the panels. The projection is in register with a cutout in the adjacent edge of the second panel. The cutoff is of sufficient size to permit the projection to swing through the opening it defines upon relative pivoting of the two doors on the hinge mounted therebetween. On the second door there is a locking member mounted which has a means permitting selective reciprocal movement into and out of register with the opening, thus permitting the opening to be selectively left open to permit passage of the projection through the opening or blocked to prevent the projection from moving through the opening thereby selectively locking and unlocking the two panels in the co-planer relationship.

A locking cam is pivotally mounted adjacent the bar for engagement with a stop projection on the bar to selectively permit the bar to be lifted. The locking cam has an associated fixed stop mounted on the panel which prevents lifting the bar out of blocking relation with the opening until the locking cam is manually pivoted out of the way to let the bar stop pass by the cam nose.

The middle of the decks at each level are provided with T-shaped cam clips behind which the adjacent panel edges of the two panel assemblies lock against the deck. With the two outboard panels of each set locked in co-planer relationship and the adjacent inboard panels of each set locked behind the cam clips, the door assemblies are locked in closed co-planer position against the deck edges. Additionally or alternatively, a cable may be utilized on the innermost or inboard panels to prevent their hinges from permitting them to swing out of the common plane of the closed position. Moreover, gravity hooks can be provided in appropriate locations to prevent an internal load from accidentally breaking the co-planer relationship of the panels when in the closed condition.

The double vertical pivoting cranks upon which the door assemblies pivot are designed, as will be seen in the Detailed Description to follow, such that the door sets may be swung approximately 110° out of the closed condition before a stop surface on the cranks engage the ends of the car housing. When a folded door assembly set is fully swung into the storage position, another stop surface on the crank acts against the fulcrum to stop the inward swing of the door. When the crank is in the fully extended position, the door assembly pivots relative to the crank until a stop projection extending from the adjacent edge of the adjacent panel engages a stop surface adjacent the outer end of the crank. The crank is held in both its storage position and closed position by means of a manually operated gravity hook which is manually removed from its keeper in order to permit pivoting of the cranks.

BRIEF DESCRIPTION OF THE DRAWINGS

A more complete understanding of the invention can be had from the following drawings and specification. In the drawings.

DETAILED DESCRIPTION OF AN EMBODIMENT OF THE INVENTION

Figure 1:
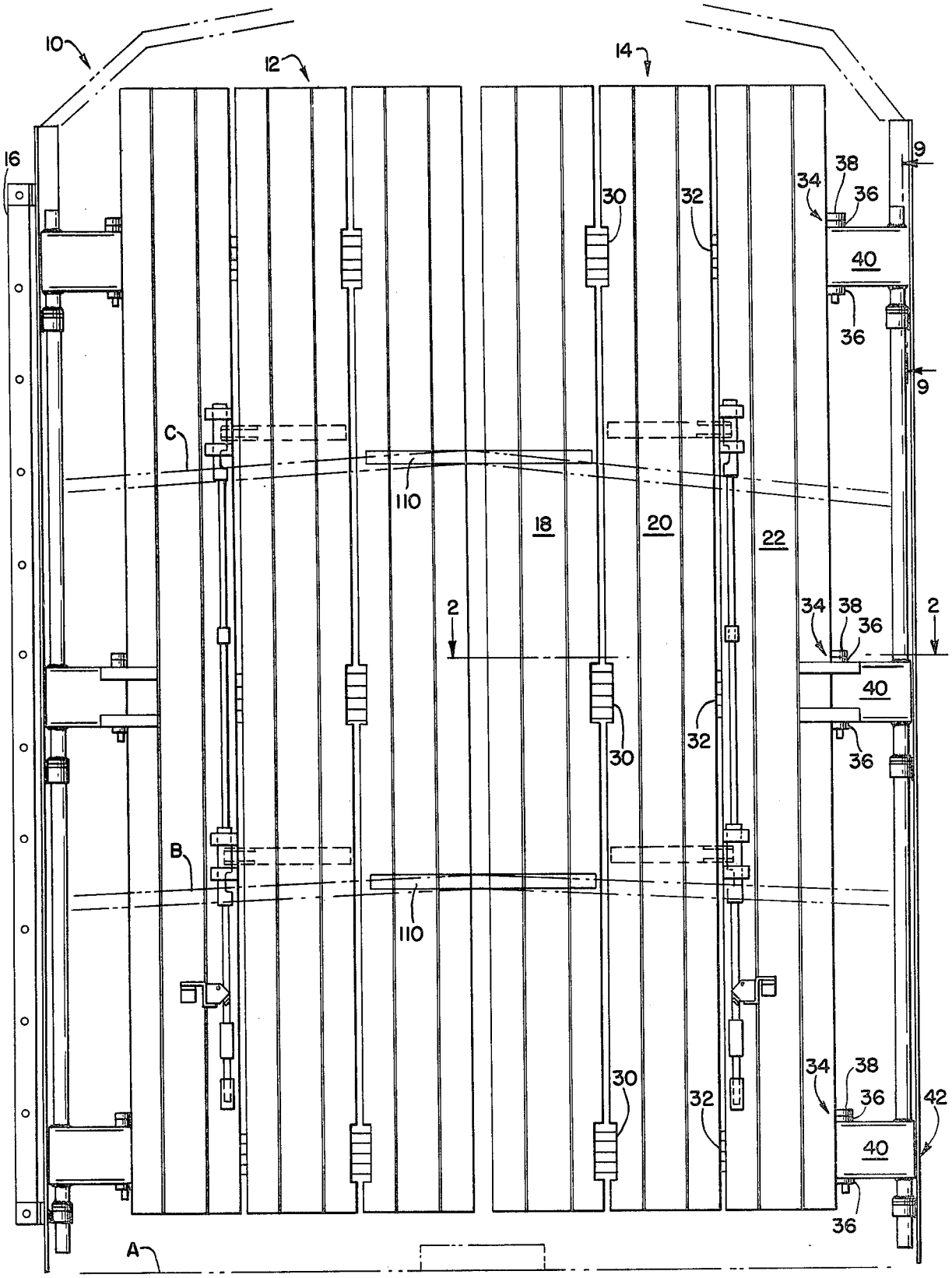
FIG. 1 is an end elevational view of a multi-deck rail car having an end opening for loading and unloading lading such as vehicles illustrating the novel door combination of this invention.

In the embodiment illustrated, the numeral 10 generally designates a multi-decked rail car.

The rail car 10 has an end opening which has its left-hand half closed by a three-paneled door set 12 and its right-hand half closed by a three-paneled door set 14. The door panel sets 12 and 14 can be termed "tri-fold" door assemblies. On the side of the car adjacent the "tri-fold" door assembly 12, a ladder 16 is normally mounted. The car 10 is of the closed three-tier automobile transport type, including three decks into which lading such as vehicles are stored for transit. The ladder 16 provides access to the upper decks.

The decks are generally known in the railroad industry as decks A, B and C, with deck A being the lowermost deck and deck C being the uppermost deck. As seen in FIG. 2, wherein the door panel set 14 is illustrated, the doors are capable of assuming many positions. In the illustrated full view position of FIG. 2, the door panel set 14 is in the closed condition. The folded storage position within the car is shown in phantom, as is the folded partially extended open position. It will be seen from FIG. 1 that the door panel set of door assembly 12 is the mirror image of set 14, as in the co-pending and co-owned application. Operators on upper decks B and C bypass the folded back and stored door units or sets and reach around to a ladder 16 on the car side adjacent the end. A description of the nature of the door assembly and how the positions illustrated in FIG. 2 are accomplished will accordingly follow.

Referring to door panel set 14 in FIG. 2, panels 18, 20 and 22 will be seen in a full top edge view in the closed position. Panels 18, 20 and 22 typically are made of 16 gauge metal. The panels all have an elongated vertical reinforcing rib 24 formed therein and all of the panel edges 26 have an inwardly extending flange 28 for further stiffening purposes. The adjacent edges 26 of the three panels 18, 20 and 22 have hinges welded thereto. The panels 18 and 20 have outwardly disposed hinges 30 with leaves welded to their respective and adjacent edges 26, and the panel 22 and the adjacent edge of panel 20 have inwardly extending hinges 32 similarly welded to the adjacent edges 26 of these panels. Panel 22 has hinges 34 with ears 36 welded to its panel edge 26, and associated hinge pins 38 rotationally mounted in a journal in one end of crank 40. The crank 40 pivots to swing out to a position parallel to the wall 42 of the car and perhaps slightly beyond. At this position, when panels 18, 20 and 22 are folded back upon themselves, as shown in the lower phantom view, they can be swung as a unit in an arc about vertical pivot shaft 44, on one end of the cranks 40, and in an arc about pins 38 on the opposite end until they clear the cut off corners of the decks B and C and pivot into the storage position with cranks 40 normal to wall 42. The storage position is shown in a phantom view at the top of FIG. 2.

The crank 40, on the end journalled or pipe shaft 44, includes stop means 46 for engagement with parallel but offset extension 47 of car wall 42 to prevent the crank and doors from pivoting beyond the desired position and outside of the clearance diagram. On the opposite end of the crank 40 is a stop surface 48 which engages an extension 49 projecting from the panel 22 adjacent the hinge 34. Engagement of the extension 49 with the stop surface 48 of crank 40 prevents the folded back door unit from pivoting about hinge 34 beyond the clearance diagram. Also on the end of the crank 40 adjacent the journal for shaft 44, is a stop surface 50. An angled fulcrum 52 is welded at a bend or offset 53 in the car wall 42 which joins it with its parallel extension 47. Thus the crank 40 is free to swing angularly between where its stop surface 50 engages angle fulcrum 52.

Figure 2:
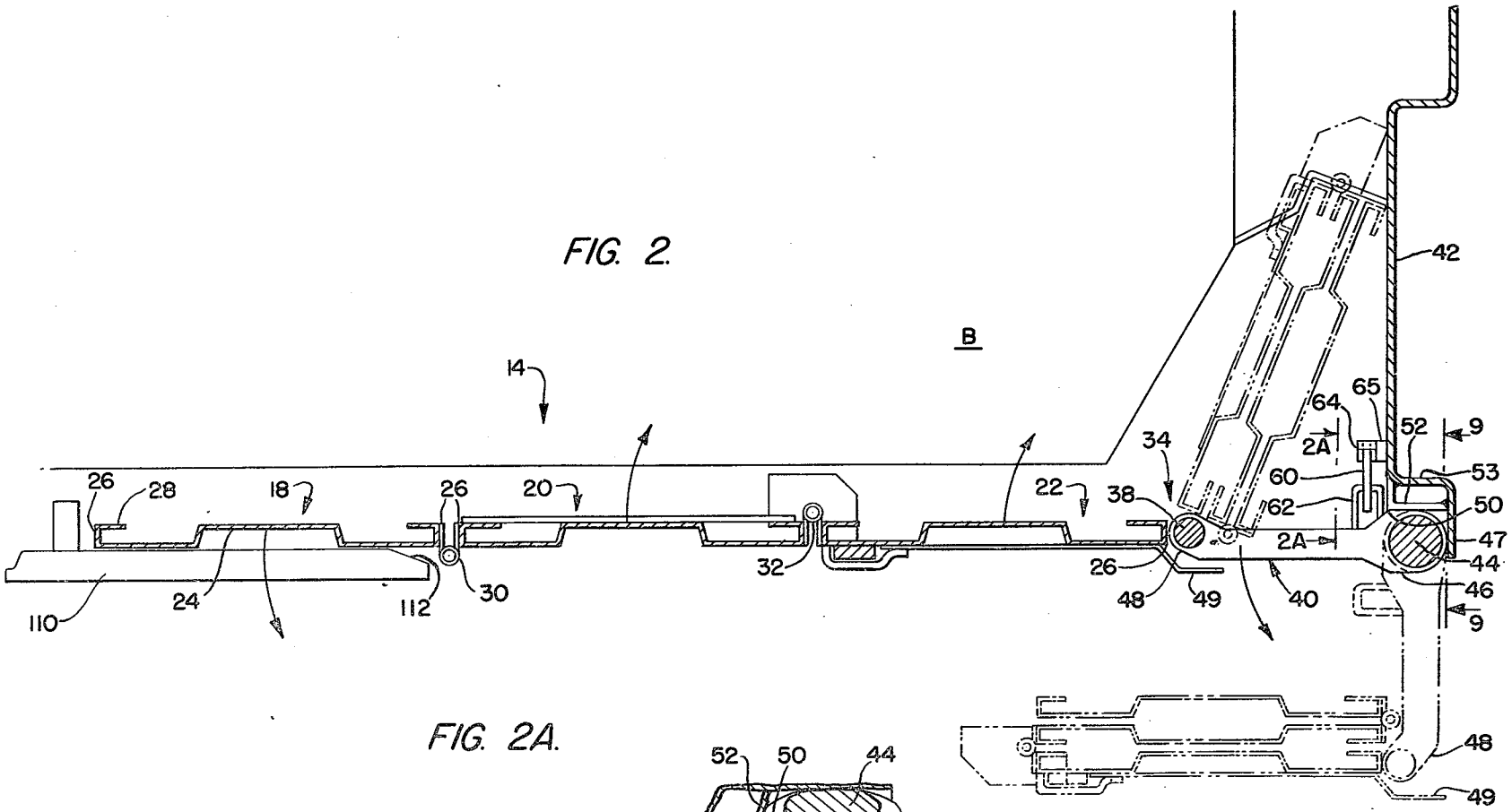
FIG. 2 is a partial cross-sectional view taken along the line 2—2 of FIG. 1 showing alternative door panel positions in phantom.
Figure 2A:
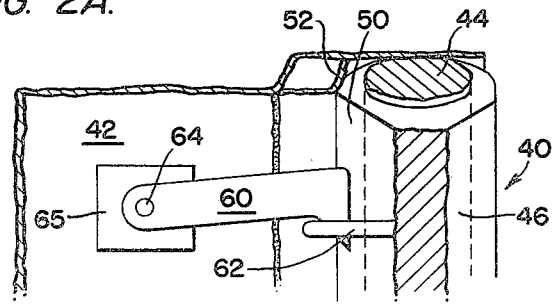
FIG. 2A is an enlarged fragmentary schematic view generally taken along the line 2A—2A of FIG. 2.
Figure 9:
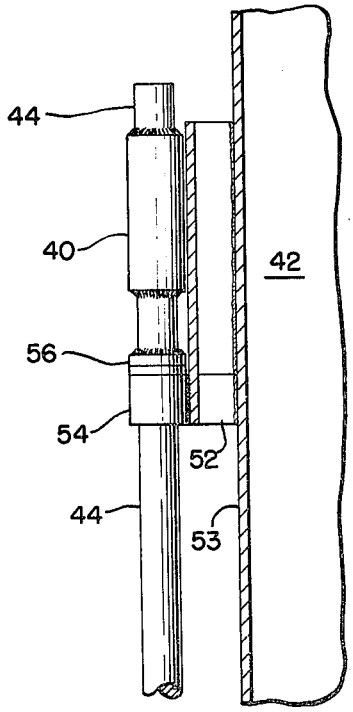
FIG. 9 is a fragmentary elevational view taken along the line 9—9 of FIGS. 1 and 2.

As is shown for example in FIGS. 1 and 9, the angle 52 is utilized to support a series of sleeves containing anti-friction material bushings 54. The sleeves are welded to angle 52. Annular shaft or pipe stops 56 welded to vertical shaft or pipe 44 rest on the upper portion of the bushings 54 and rotatively support the shaft 44 at three locations below the three cranks 40.

The crank 40 can be held in a position generally normal to the car wall 42 by means of a gravity hook 60. The hook 60 has a keeper 62 welded on the crank 40 and is pivotally mounted by means of pivot pin 64 and mounting plate 65 on the wall 42 adjacent the end of the crank 40 journalled on vertical pivot shaft 44. As will be seen, when the hook 60 is engaged with its keeper 62, and the door panels 18, 20 and 22 are in closed position, the crank 40 cannot move to the position shown in phantom in the lower portion of FIG. 2. Therefore, the door panel 20 and 22 cannot swing in their clockwise direction about hinges 32 and 34 respectively because they are blocked by the edge of the decks B and C. By the same token, when the doors are in the stored position as shown in phantom in the upper portion of FIG. 2 with the gravity hook 60 behind its keeper 62, the crank 40 is unable to swing in one direction because of stop surface 50. The hook 60 also prevents the door panels 18, 20 and 22, when folded back upon themselves in storage, from clearing the decks B and C even though the corners are cut off, since it is only by pivoting about both vertical shaft 44 and about hinge pin 38 that the folded back door sets clear the decks B and C. It is this double pivoting action which permits, however, a compact storage and a positively locked condition by means of the hook 60 and keeper 62. As readily apparent, the hook 60 can be lifted manually to permit the double pivoting action which permits the crank 40 to pivot the folded back door unit 14 out of storage sufficiently for clearance of the decks B and C and thereafter to be opened and placed in co-planer relationship in the car closed condition.

Figure 5:
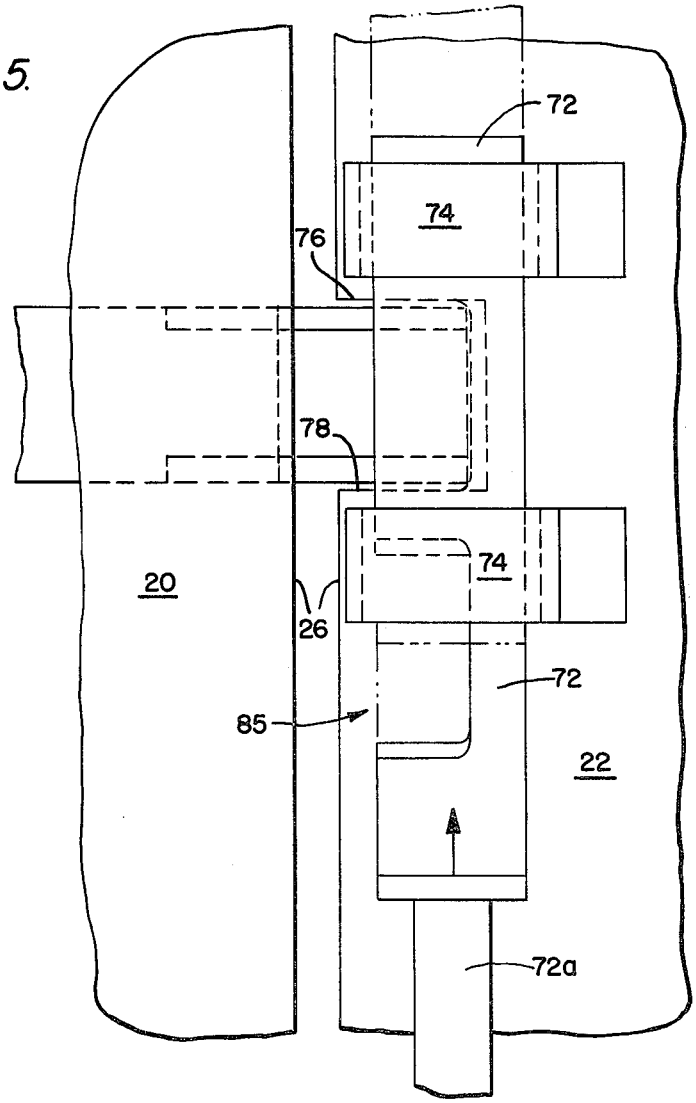
FIG. 5 is an enlarged fragmentary view of a portion of the locking means of FIG. 3 taken along the line 5—5 of FIG. 4.

In the closed position two adjacent panels 20 and 22 of each door assembly or set can be locked together by means which maintain them in co-planer relationship. A projecting metal member 70 is mounted on the rear edge 28 of panel 20 and extends beyond its edge 26 and is L-shaped such that it is also attached to edge 26 at vertical locations along the edge between the hinges 32. The leg of the L-shaped member 80 which projects from and past the edge 26 of panel 20, extends not only behind the edge 26 and flange 28 of panel 22, but into an opening or recess cut through them. Projecting member 70, however, cannot move entirely through the opening because of a bar 72 reciprocably mounted behind straps 74 welded on the outer face of panel 22 which blocks the opening or cutout. The cutout can perhaps best be seen in FIG. 5 and has a top edge 76 and a lower edge 78.

Figure 4:
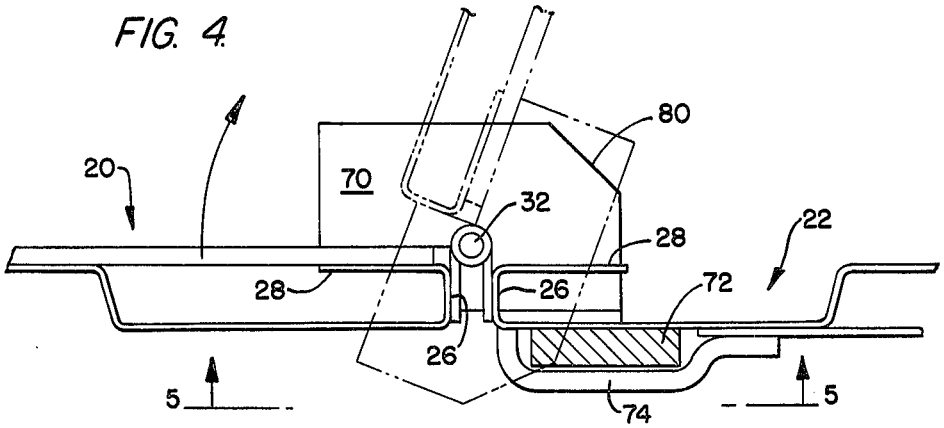
FIG. 4 is a cross-sectional view taken along the line 4—4 of FIG. 3.

The L-shaped projecting member 70 is mounted to extend from the panel 20 into the recess defined by edges 76 and 78 and has a corner cut off, as seen at 80, such that the member 70 could normally swing through the recess defined in the edge 26 of panel 22 as the hinge 32 pivots the panel 20 clockwise, as seen in FIG. 4, until the backsides of panels 20 and 22 are in back-to-back relation. The bar 72, however, reciprocably mounted in strap 74 welded on the face of panel 22 prevents the member 70 from passing entirely through the opening in the edge of panel 22 and therefore in the condition shown, maintains the locked co-planer relationship between the panels 20 and 22.

The bar 72 mounted in strap 74 for vertical reciprocal movement includes extension portions **72*a* which interconnect a plurality of locking bar portions 72*b*. The locking portions 72*b* of the bar 72 have a recessed or open portion 85 which can be reciprocated upwardly from the locked position into register with the openings in the edge of panel 22 defined by upper edges 76 and lower edges 78. When the opening 85 is in register with the opening and the edge of panel 22, the blocking member 70 can clear the entire opening as the panel 20 is pivoted clockwise about hinge 32 into back-to-back relation to panel 22. Again, with the cut off corner 80, clearance is made possible as will be seen in phantom in FIG. 4**.

Figure 3:
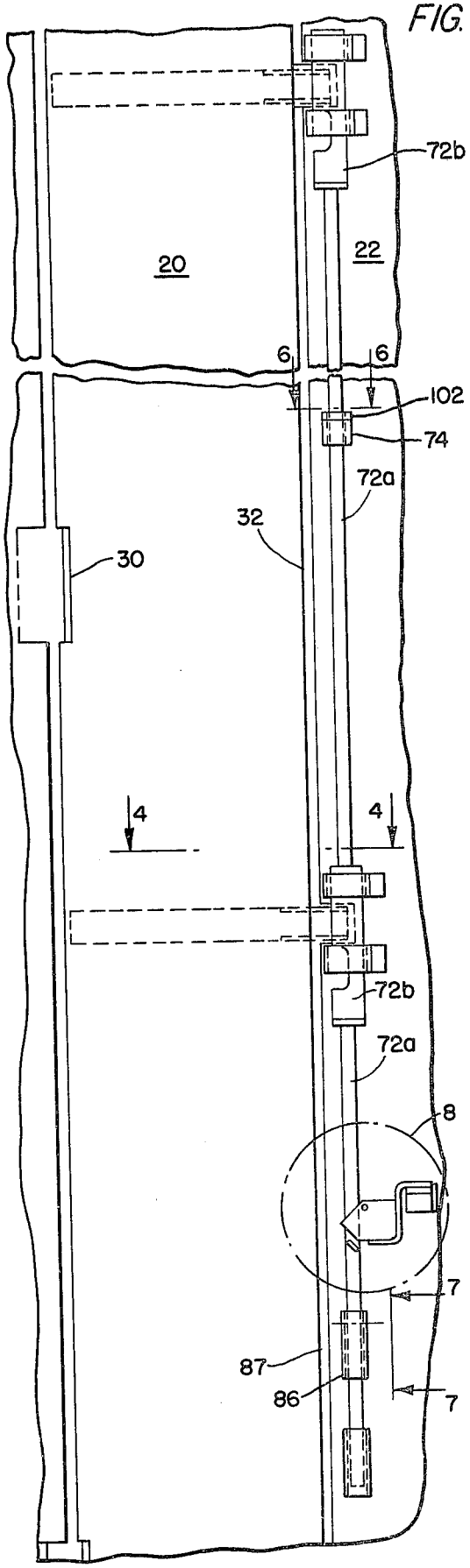
FIG. 3 is an enlarged fragmentary view of a portion of FIG. 1 illustrating the locking means.
Figure 6:
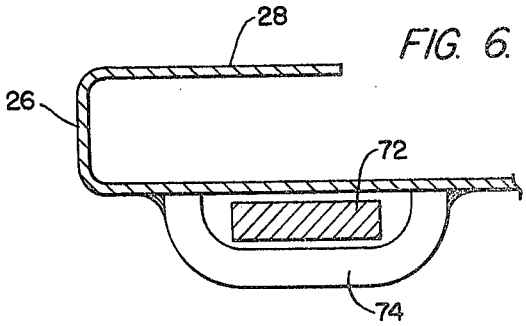
FIG. 6 is a cross-sectional view taken along the line 6—6 of FIG. 3.
Figure 7:
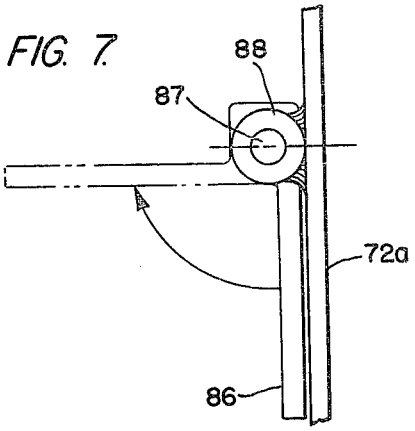
FIG. 7 is an elevational view taken along the line 7—7 of FIG. 3.

Thus, it will be seen that when the bar 72 is at a lower position, the panels are locked in co-planer relationship, but when the bar 72 is reciprocated upwardly so that the opening 85 is in register with the opening defined by upper edges 76 and lower edges 78, the door panels 20 and 22 may be folded into back-to-back relationship to make a compact unit for storage. The bar 72 is reciprocated upwardly by means of a handle 86 which pivots about a pin 87 which is journalled for rotation in a pair of bushings 88 welded to the bar **72*a*, as best seen in FIGS. 3 and 7**.

Figure 8:
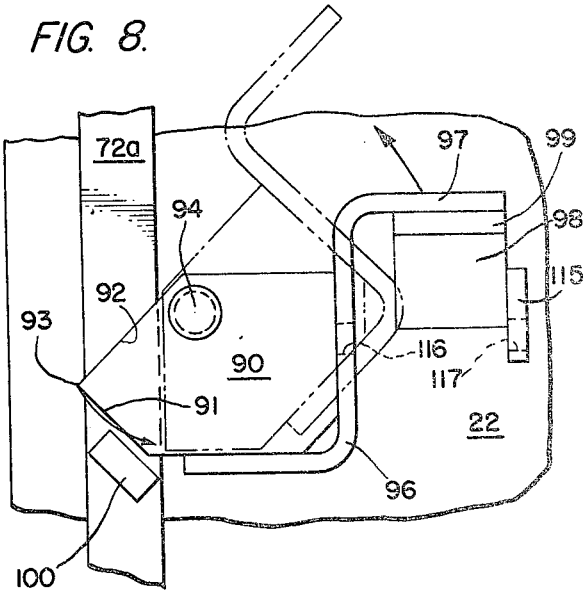
FIG. 8 is an enlarged fragmentary view of area 8 of FIG. 3.

FIG. 8 illustrates a locking cam 90 having a surface 91 and a surface 92 which converge to define a nose 93. The locking cam 90 is pivoted about a pin 94 and includes a Z-shaped member 96 which is secured to it at its two sides opposite the sides 91 and 92. Z-shaped member 96 has a projecting portion 97 for engagement with an angle 98 welded on panel 22 and having an upper flange stop surface 99. The engagement of the extension 97 rigidly attached to locking cam 90 with the flange 99 prevents rotation of the locking cam about the pivot pin 94 in a clockwise direction. The location of the pivot pin 94, relative to the center of mass of the locking cam 90 and its associated member 96 with extension 97, is such that the locking cam is normally biased in a clockwise direction. Accordingly, the normal condition is for the extension 97 to be in engagement with the stop flange 99.

Mounted on the bar 72, in the lower portion **72*a*, is a bar stop 100. The bar 72 will not normally be permitted to be reciprocated vertically upwardly by means of handle 86 because the locking cam nose 93 formed by surfaces 91 and 92 of locking cam 90 block passage of the bar stop 100. Accordingly, to reciprocate the bar 72 vertically upwardly and thereby permit unlocking of panels 20 and 22 from co-planer relationship, it is necessary manually to move the locking cam 90 counter-clockwise so that the nose 93 permits upward bypassing of the bar stop 100. Thus, by moving the locking cam 90 counter-clockwise and upwardly reciprocating the bar 72, the recess in the edge of panel 22 is opened by bringing the opening 85 of bar portion 72*b* in register with the panel opening. The panels 20 and 22 then can be folded in back-to-back relation and the panel 18 brought around its hinge 30 with panel 20** in back-to-back relation making the fully folded three-panel unit.

When it is desired to unfold the doors to place them back in co-planer relationship, the weight of bar 72 is such that bar stop 100 will engage surface 92 and cam 90 will be pushed counterclockwise past the nose 93 by gravity until stopped by projection 102 of bar 72 hitting strap 74. Cam 90 will then drop back clockwise until extension 97 engages flange 99 to again lock panels 20 and 22 in co-planer relationship.

With the locking means 90 and bar 72 maintaining the co-planer relationship of the panels 20 and 22, the co-planer relationship of the panels 18 and 20 is accomplished by means of T-shaped cam clips 110 mounted on the center portions of the edges of decks B and C, as by welding. The T-shaped cam clip 110 has a camming surface 112 to facilitate pivotal entrance of the leading edge 26 of the panel 18 behind it and between it and edges of the decks B and C. Also, gravity hooks and keepers, as well as cables, can be applied as desired to supplement the described locking structure.

When the car is in the locked condition, the associated member 96 of locking cam 90 and an ear 115 welded on the panel 22 adjacent thereto have, respectively, aligned apertures 116 and 117 for receipt of a seal. In this way the locking cam 90 becomes a sealing cam and it is possible to seal a car to determine whether it has been tempered with during transit.

Having described the illustrated embodiment, I wish to state that it is not my intention to be limited thereto but to be limited rather only by the scope of the appended claims.

What is claimed is:

1. In a rail car having an interior cavity and an end opening for loading and unloading lading:

a door assembly including a plurality of panels each pivotally movable with respect to the other for closing at least a portion of said opening, lock means, mounting means including a double vertical pivot means in addition to the pivot means making the panels each pivotally movable with respect to the other, for moving said door assembly between a stored position with the panels folded back upon one another as a unit at least partially within said cavity and a closed position in which said panels may be locked in substantially co-planer relationship, said double vertical pivot means are cranks journalled at both ends, the first portion of said double vertical pivot means operable for pivoting of the door assembly about a first vertical axis adjacent the opening defining the end edge of the car side wall and the second portion of said double vertical pivot means operable for pivoting of the door about a second vertical axis laterally spaced from the first and located adjacent the outmost edge of the outermost panel.

2. The rail car of claim 1.in which at least one of said cranks is limited in its rotational movement in one direction by a surface portion thereon which engages a portion of said car side wall.

3. The rail car of claim 1 in which two adjacent panels of said door assembly pivotally movable with respect to each other may be locked in co-planer relationship by the lock means which comprises:

a rigid projection extending from an edge of a first one of said panels behind and past an adjacent edge of the second of said two panels in register with a cutout in said adjacent edge of said second panel, said cutout being of sufficient size to permit said projection to swing through the opening it defines upon relative pivoting of said two panels, a locking member mounted on said second panel having blocking means thereon for selective reciprocal movement into and out of register with said opening to selectively block said projection from passing through said opening or to permit passage of said projection through said opening thereby selectively locking and unlocking said two panels in co-planer relationship.

4. In a rail car having an interior cavity and an end opening for loading and unloading lading:

a door assembly including a plurality of panels each pivotally movable with respect to the other for closing at least a portion of said opening, lock means, mounting means in addition to the pivot means making the panels each pivotally movable with respect to the other, for moving said door assembly between a stored position with the panels folded back upon one another as a unit at least partially within said cavity and a closed position in which said panels may be locked in substantially co-planer relationship, two adjacent panels pivotally movable with respect to each other being capable of being selectively locked in co-planer relationship by the lock means which comprises:

a rigid projection extending from an edge of a first one of said panels behind and past an adjacent edge of the second of said two panels in register with a cutout in said adjacent edge of said second panel, said cutout being of sufficient size to permit said projection to swing through the opening it defines upon relative pivoting of said two panels, a locking member mounted on said second panel having blocking means thereon for selective reciprocal movement into and out of register with said opening to selectively block said projection from passing through said opening or to permit passage of said projection through said opening thereby selectively locking and unlocking said two panels in co-planer relationship.

5. In a rail car having an interior cavity and an end opening for loading and unloading lading:

a door assembly including a plurality of panels each pivotally movable with respect to the other for closing at least a portion of said opening, lock means, mounting means, in addition to the pivot means making the panels each pivotally movable with respect to the other, for moving said door assembly between a first position and a second, closed position in which said panels may be locked in substantially co-planer relationship, two adjacent panels pivotally movable with respect to each other being capable of being selectively locked in co-planer relationship by the lock means which comprises:

a rigid projection extending from an edge of a first one of said panels behind and past an adjacent edge of the second of said two panels in register with a cutout in said adjacent edge of said second panel, said cutout being of sufficient size to permit said projection to swing through the opening it defines upon relative pivoting of said two panels, a locking member mounted on said second panel having blocking means thereon for selective reciprocal movement into and out of register with said opening to selectively block said projection from passing through said opening or to permit passage of said projection through said opening thereby selectively locking and unlocking said two panels in co-planer relationship.

6. The rail car of claim 5 in which said blocking means is mounted such that said selective reciprocal movement is in a vertical direction and is caused by gravity in the downward direction and is caused by manual lifting in the upward direction.

7. The rail car of claim 6 in which the manual lifting of said blocking means moves said blocking means out of said opening to unlock said two panels from co-planer relationship.

8. The rail car of claim 7 in which said blocking means has a horizontal projection and is normally prevented from upward movement by engagement of said projection by a pivoted locking cam mounted on one of said panels, stop means on said one panel normally and selectively to engage said cam to prevent upward movement of said blocking means.

9. The rail car of claim 8 in which the pivoted locking cam and associated stop means mounted on said one of said panels is arranged such that said pivoted locking cam is biased in one direction against said stop means thereby to prevent upward movement of said blocking means, but whereby said pivoted locking cam can be manually pivoted against said bias to permit passage of said projection past said cam to permit upward movement of said blocking means and corresponding movement of said blocking means out of said opening to unlock said two panels from co-planer relationship.

10. The rail car of claim 9 in which said pivoted locking cam and an ear projecting from a panel have aligned openings when said pivoted locking cam is in its biased condition against said stop for receipt of a seal means.

* * * * *